United States Patent [19]

Elderfield

[11] 4,398,703

[45] Aug. 16, 1983

[54] TUYERES WITH HEAT PIPES AND METHOD OF MANUFACTURING

[75] Inventor: Raymond N. Elderfield, Sheffield, England

[73] Assignee: Carblox Limited, Sheffield, England

[21] Appl. No.: 254,531

[22] Filed: Apr. 15, 1981

[30] Foreign Application Priority Data

Apr. 24, 1980 [GB] United Kingdom ..... 8013470

[51] Int. Cl.[3] ..... C21B 7/16

[52] U.S. Cl. ..... 266/270; 29/157.3 R; 165/47

[58] Field of Search ..... 29/157.4, 157.3 R; 266/270; 165/47 H

[56] References Cited

U.S. PATENT DOCUMENTS 4,258,633 3/1981 Elderfield ..... 266/270

FOREIGN PATENT DOCUMENTS

WO80/01201 6/1980 PCT Int'l Appl. ..... 266/193

*Primary Examiner*—M. J. Andrews

*Attorney, Agent, or Firm*—William R. Hinds

[57] ABSTRACT

The tuyere for a blast furnace, the tuyere having a body part (10) with cooling means extending rearwardly from a nose portion of the body (10).

In order that a failure of the tuyere when in service does not result in large quantities of water entering the furnace, the cooling means are constituted by a plurality of heat pipes, the heat pipes being formed either in tubes (12) cast in the body part (10) or being formed in holes (112) drilled in said body part.

6 Claims, 6 Drawing Figures

TUYERES WITH HEAT PIPES AND METHOD OF MANUFACTURING

Figure 1:
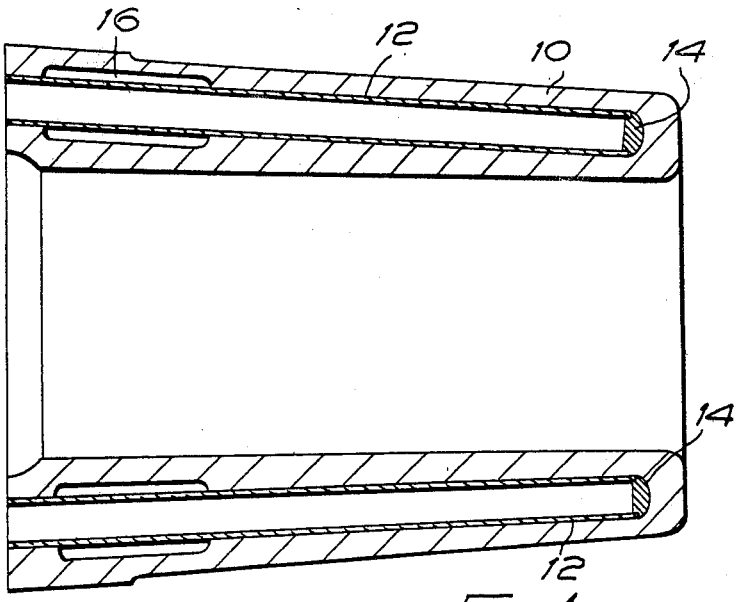

The invention relates to the manufacture of tuyeres for use in blast furnaces and has for its object to provide an improvement therein.

The tuyeres of blast furnaces are nozzles for blasts of air blown into the furnace during its operation to provide the necessary reaction with the coke therein. This generates intense heat for the operation of the furnace. The tuyeres are subjected to very severe operating conditions and it is necessary for heat to be transmitted away from them at a very high rate throughout the operation of the furnace. For this reason they are invariably made of copper and in the past it has been commonplace to transfer the heat away by the use of water flowing through passages formed in the walls of the tuyeres and extending into their nose portions, that is to say, those portions which project into the furnace environment and which are therefore extremely vulnerable. Failure of a tuyere does occur from time to time due to molten metal locally burning through the copper at the nose portion and breaking into one or more of the passages carrying cooling water. At such a time the flow of cooling water must be immediately shut off and this then results in the total destruction of the tuyere. This failure is inconvenient for two reasons. Firstly, ingress of large quantities of water into the furnace causes cooling of the iron therein and oxidation of the carbon refractories. Secondly, the need for frequent interruption of the furnace operation to enable the replacement of the tuyere to be carried out is both costly and troublesome. The present invention aims to provide a method of manufacturing a tuyere which will at least alleviate such difficulties which have been encountered in the past.

According to one aspect of the invention, there is provided a method of manufacturing a tuyere for use in a blast furnace, the method involving the step of casting a tuyere body with a plurality of cast-in tubes so that said tubes extend generally longitudinally of said tuyere body between its wall thickness, that is to say extend rearwardly from near a nose portion of said body, and the subsequent step of forming a heat pipe (that is to say a low pressure, boiling/condensing unit) of each of said tubes. When the method involves the casting-in of a plurality of tubes, it will preferably include the initial step of plugging the tube ends which are to be located at the nose end of the tuyere body, before the tubes are located in a mould in which the tuyere body is to be cast. Also when the method involves the casting-in of a plurality of tubes the method will preferably involve the coring of an annular cooling water cavity in the tuyere body in a rearward part of said body, that is to say remote from the nose portion thereof, said cooling water cavity being located between the wall thickness of said body so that in the finished tuyere the condenser (heat removal) sections of the heat pipes or the elongate tubular cap elements constituting condenser (heat removal) sections, as the case may be, extend through said cavity and can be cooled by cooling water circulated through said cavity through flow and return passages extending through a back face of the tuyere and into said cavity, the flow and return passages preferably being at diametrically opposite locations at the back face of the tuyere. Alternatively, the tubes which are to be cast in the tuyere body may be initially cut to a length much greater than the length of the tuyere body so that when the tuyere is in use the condenser (heat removal) sections of the heat pipes can be cooled by heat exchanger apparatus located wholly outside the furnace.

According to another aspect of the invention, there is provided a tuyere for use in a blast furnace, the tuyere having been manufactured by the method referred to above.

Figure 2:
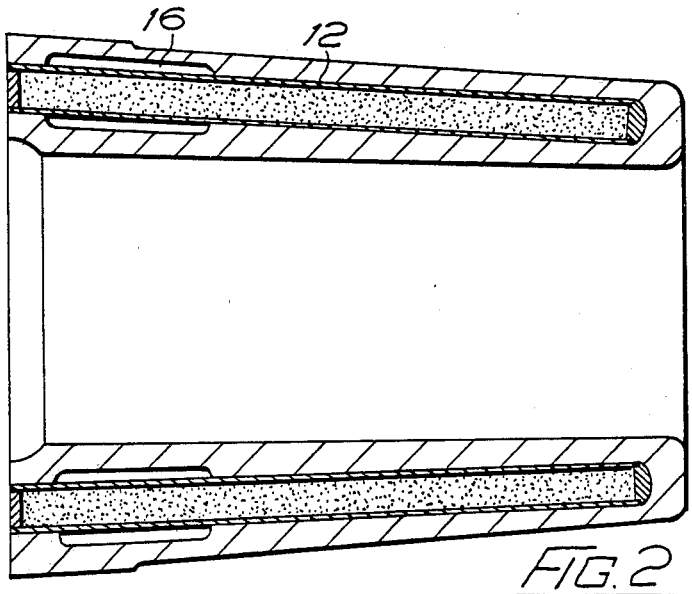
Figure 3:
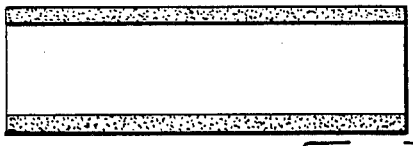
Figure 4:
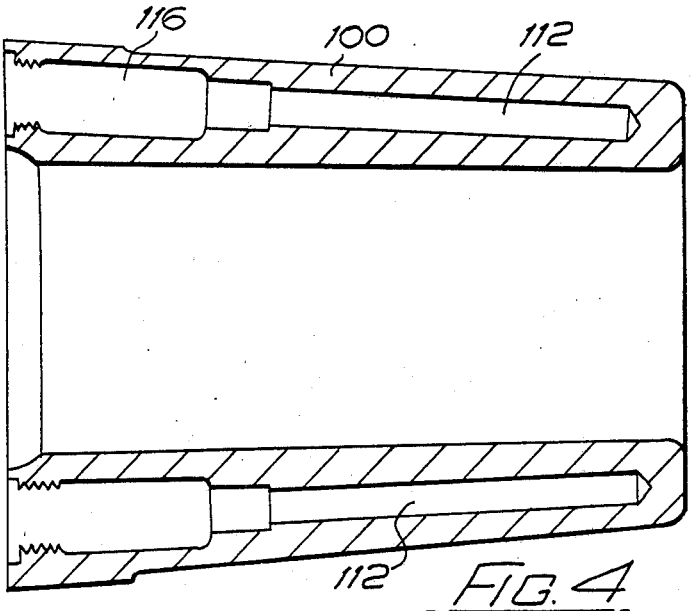
Figure 5:
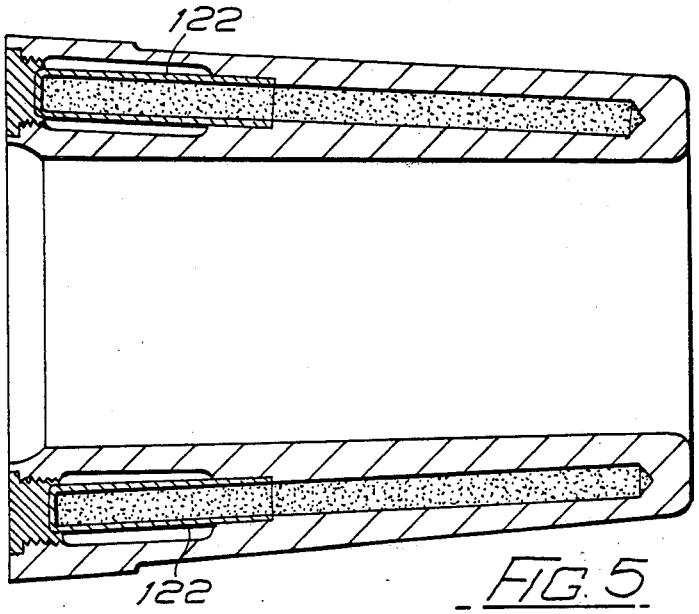
Figure 6:
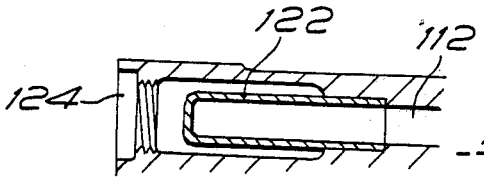

In order that the invention may be fully understood and readily carried into effect, the same will now be described, by way of example only, with reference to the accompanying drawings, of which:

FIG. 1 is a diagrammatic view illustrating an initial step in a method a tuyere manufacture embodying the invention, FIG. 2 is a view illustrating the finished tuyere, FIG. 3 is a diagrammatic view illustrating the construction of a heat pipe, FIG. 4 is a view similar to FIG. 1, and illustrating an initial step in a modified method of manufacture, FIG. 5 is a view illustrating the finished tuyere, and FIG. 6 is a scrap view illustrating a possible variation of the method of manufacture of FIGS. 4 and 5.

Referring now to FIG. 1 of the drawings, this illustrates an intermediate stage in the manufacture of a tuyere by a method embodying the invention, that is to say, it illustrates a tuyere body 10 which has been produced as a copper casting. The body is provided with a plurality of cast-in tubes 12 which have been positioned so that in the resulting casting said tubes extend generally longitudinally of the tuyere body between its wall thickness, that is to say they extend rearwardly from near a nose portion of the tuyere body to emerge at a rear face. The method has also included the initial step of plugging with plugs 14 the tube ends which are to be located at the nose end of the tuyere body before the tubes have been located in the mould (not shown) in which the tuyere body has been cast. The casting of the body 10 has involved the coring of an annular cooling water cavity 16 in a rearward part of said body, that is to say remote from the nose portion, said cooling water cavity being located as shown between the wall thickness of the body so that in the finished casting the cast-in tubes 12 extend through said cavity.

Referring now to FIG. 2 of the drawings, it will be seen that in a subsequent step in manufacture of the tuyere each of the previously open ended cast-in tubes 12 has been converted into a heat pipe (in a manner which will be well known to those skilled in the art of heat pipe manufacture) and their ends have then been suitably sealed. A final step in the manufacture of the tuyere has involved the screwthreading of flow and return passages (not shown) which extend through the back face of the body part into the annular water cooling cavity 16, said flow and return passages conveniently being located at diametrically opposite positions one from the other.

A heat pipe is diagrammatically illustrated in FIG. 3 and is shown to be a sealed, low pressure, boiling/condensing tubular unit utilizing capillary action for condensate return to an evaporator (heat input) section from a condenser (heat removal) section, the tubular unit having a lining material constituting a wick. Consequently, it will be understood that the step of converting each one of the previously open ended cast-in tubes 12 into a heat pipe will involve the application of the lining material constituting the wick, the evacuation of air from the tube, and the introduction into the tube of a quantity of a suitable working fluid before the open end of the tube has been sealed.

It has been found that the method of manufacture described above has been advantageous in several respects. For example, the fact that the tubes 12 have been cast in the body part ensures perfect heat transfer from the body part to the heat pipes (which would not be the case if the heat pipes had simply been entered into drilled holes in the body part). On the other hand, finished heat pipes could not have been cast in the body part of the tuyere because the heat of the molten metal during the casing operation would have destroyed the heat pipes.

Various modifications may be made without departing from the scope of the invention.

In FIGS. 4 and 5 there is illustrated a method of manufacture which involves the initial step (FIG. 4) of drilling a plurality of holes 112 in a pre-cast tuyere body 100, said holes extending generally longitudinally of the body between its wall thickness so that they extend rearwardly from near the nose portion of the body and extend through the annular cooling water cavity 116 which has been cast in a rearward part of the body. A subsequent step (FIG. 5) of forming a heat pipe of each of said drilled holes has again been carried out in a manner well known to those skilled in the art of heat pipe manufacture but has involved the step of fitting an elongate tubular cap element 122 in each drilled hole so that each cap element extends through the cooling water cavity as shown and constitutes a condenser (heat removal) section of the respective heat pipe.

In a variation of this last described modification, the cap elements 122 are somewhat shorter, as shown in FIG. 6, so that they simply extend into the cooling water cavity and in use of the tuyere the cooling water can flow around the end surfaces of said cap elements. In this case of course a further step is required in the manufacture of the tuyere, that is to say the plugging of the holes in the back surface of the body part by the plug elements 124.

Various other modifications may be made. For example, in FIG. 1 the cast-in tubes 12 are shown to be plain bore tubes, but it will be understood that if it is required to increase the internal surface areas of the heat pipes so as to increase their heat removal capacity it will be possible to use different tube forms, for example longitudinally ribbed tube, and such tube could either be internally ribbed tube with a plain cylindrical outer surface or could be ribbed tube of uniform wall thickness. It will also be understood that whatever the subsequent method of manufacture the tubes which are to be cast in the tuyere body may be initially cut to a length much greater than the length of the tuyere body (or the elongate tubular cap elements 122 in the method described with reference to FIGS. 4 and 5 could be made considerably longer) so that when the tuyere is in use the condenser (heat removal) sections of the heat pipes can be cooled by heat exchange apparatus located wholly outside the furnace.

It will be understood that the failure in use of a tuyere which has been manufactured by a method embodying the invention will not be such a serious matter as hitherto. This is because the failure of such a tuyere will not immediately break into the cooling water cavity so that water will not flow into the furnace. Consequently, failure of the tuyere will not interrupt the furnace operation and will not be likely to cause cooling of the iron in the furnace or oxidation of the furnace lining.

What I claim and desire to secure by Letters Patent is:

1. A method of manufacturing a tuyere for use in a blast furnace, the method comprising the step of casting in a mold a tuyere body with one or more cast-in tubes so that said tube(s) extend generally longitudinally of said tuyere body between its wall thickness, and thus extend rearwardly from near a nose portion of said body, and the subsequent step of forming in situ a low pressure, boiling/condensing heat pipe of each of said tube(s) by installing a wick material, evacuating the tube(s), introducing a working fluid, and sealing the tube(s).

2. A method according to claim 1 of manufacturing a tuyere for use in a blast furnace, including the initial step of plugging the tube end(s) which are to be located at the nose end of the tuyere body, before the tube(s) are located in a mould in which the tuyere body is to be cast.

3. A method according to claim 1 of manufacturing a tuyere for use in a blast furnace, the method including the coring of an annular cooling water cavity in the tuyere body in a rearward part of said body remote from the nose portion thereof, said cooling water cavity being located between the wall thickness of said body so that in the finished tuyere the condenser sections of the heat pipes extend into said cavity and can be cooled by cooling water circulated through said cavity through flow and return passages extending through a back face of the tuyere and into said cavity, the flow and return passages being at diametrically opposite locations at the back face of the tuyere.

4. A method according to claim 1 of manufacturing a tuyere for use in a blast furnace, in which tube(s) which are to be cast in the tuyere body are at least initially of a length much greater than the length of the tuyere body.

5. A tuyere made by the method claimed in claim 1 for use in a blast furnace, the tuyere having a body with one or more cast-in tubes extending generally longitudinally of the tuyere body between its wall thickness, and thus extending rearwardly from near a nose portion of said body, each of said tube(s) being formed as a low pressure, boiling/condensing heat pipe containing a wick material and a working fluid, and being sealed.

6. A tuyere according to claim 5, including an annular cooling water cavity in the tuyere body in a rearward part of said body remote from the nose portion thereof, said cooling water cavity being located between the wall thickness of said body so that the condenser section(s) of the heat pipe(s) extend into said cavity and can be cooled by cooling water circulated through said cavity through flow and return passages extending through a back face of the tuyere and into said cavity, the flow and return passages being at diametrically opposite locations at the back face of the tuyere.

* * * * *